US005740957A

United States Patent [19]

Wenkman

[11] Patent Number: 5,740,957

[45] Date of Patent: Apr. 21, 1998

[54] FRAME AND MAILER FOR PHOTOGRAPHS

[76] Inventor: Gregory J. Wenkman, 6690 Shamrock Glen Cir., Middleton, Wis. 53562

[21] Appl. No.: 517,997

[22] Filed: Aug. 22, 1995

[51] Int. Cl.[6] ..... B42D 15/00

[52] U.S. Cl. ..... 229/92.8; 40/755; 40/774; 40/775

[58] Field of Search ..... 229/92.8; 40/754, 40/755, 773, 774, 775, 748, 749, 750

[56] References Cited

U.S. PATENT DOCUMENTS

| | | | |
|---|---|---|---|
| 1,655,539 | 1/1928 | Freddman | 40/755 |
| 3,174,244 | 3/1965 | Walton | 40/774 |
| 3,545,115 | 12/1970 | Nichols | 40/750 |
| 4,167,241 | 9/1979 | Zumbrunn | 229/92.8 |
| 4,244,511 | 1/1981 | Coleman | 40/774 |
| 4,450,638 | 5/1984 | Bader | 40/754 |
| 4,681,253 | 7/1987 | Engelhardt | 229/92.8 |
| 4,801,076 | 1/1989 | Schoenleber et al. | 229/92.8 |
| 5,133,496 | 7/1992 | Davidson et al. | 229/92.8 |
| 5,337,949 | 8/1994 | Seeley | 40/774 |
| 5,361,521 | 11/1994 | Burtch | 40/750 |

FOREIGN PATENT DOCUMENTS

| | | | |
|---|---|---|---|
| 8906192 | 7/1989 | WIPO | 229/92.8 |

*Primary Examiner*—Stephen P. Garbe
*Attorney, Agent, or Firm*—Quarles & Brady

[57] ABSTRACT

Photograph framing and mailing device and blank sheet for forming the device are disclosed. When assembled, the device includes panels that frame a photograph, panels that enclose a photograph for delivery purposes, and panels that support a photograph and the framing panels in a horizontal or vertical display orientation. Some of the panels can be used to include written communication and in place of other mailing packaging material.

25 Claims, 6 Drawing Sheets

FRAME AND MAILER FOR PHOTOGRAPHS

FIELD OF THE INVENTION

The field of the invention is framing and mailing units for photographic prints and in particular a unit that can operate both as a mailing sheath and a framing device.

BACKGROUND OF THE INVENTION

In today's ever increasingly mobile world, jobs, climate, and lifestyle choices often require people to move to distant parts of the country and world, thus separating family and friends often for months and even years at a time. One of the most popular ways to maintain contact over long distances has been through the various mail services which facilitate inexpensive communication and hence lighten the burden of maintaining long distance relationships. While the mail services, combined with technology which provides inexpensive photographs and writing materials, have enabled cost effective long distance communication, sending photographs through the mail has proven problematic for a number of reasons.

For example, while soft envelopes and the like have generally provided sufficient protection for letters which remain readable even after being creased or bent a plurality of times, often soft envelopes cannot provide sufficient protection for photographic pictures which can easily be damaged or destroyed when bent or creased.

One solution to this problem is to encase photographs in cardboard or the like prior to mailing. Nevertheless, because most photographs are relatively slippery, they can often partially slide out of encasing cardboard, their edges becoming frayed and damaged in transport. In addition, this solution is relatively costly, requiring the purchase of both supporting cardboard and an envelope having increased proportions to accommodate a letter, a picture, and the supporting cardboard.

Another problem with sending a photograph through the mail is that when received, the recipient is burdened with the work of framing or mounting the photograph in a picture frame or the like in order to protect and display the photograph in an appealing manner. This is both costly and time consuming.

While both of the problems identified above can be overcome by providing an actual frame around the picture, this solution is objectionable because it increases the cost of shipping considerably and requires extensive additional work on the part of the of the person sending the picture. Moreover, where glass is included with the frame, additional protection and supporting structure would be required.

Thus, it would be advantageous to have an inexpensive packaging device that supports and protects a picture during transport and that operates as an appealing framing device after a picture is received.

SUMMARY OF THE INVENTION

The present invention includes a paperboard framing device constructed of a single piece of paperboard that fully encases a photograph during transport and operates as a framing mechanism after a photograph is received. Thus, the present device protects a photograph during transport and facilitates appealing display after reception.

The invention includes a one-piece blank sheet of foldable material (such as lightweight paperboard) for use in forming a photograph framing and mailing device. The blank sheet comprises a frame panel having two lateral edges and upper and lower edges, the frame panel forming an aperture, upper and lower flap panels connected at fold lines to the upper and lower edges of the frame panel respectively, a back panel having first and second lateral edges and including a back frame portion and a supporter (i.e. easel stand) that is connected to the back frame portion by at least one fold line, the first lateral edge of the back panel connected to a lateral edge of the frame panel at a fold line. The device also includes an exterior panel sized and shaped so as to be at least as large as the frame panel, the exterior panel having two lateral edges, the first lateral edge of the exterior panel connected to the second lateral edge of the back panel along a fold line.

The panels of the blank sheet are juxtaposed such that when the device is assembled by folding the sheet along the fold lines, the upper and lower flap panels and the frame panel form a structure within which a photograph is securable, the supporter is moveable between a stowed position parallel to the frame panel and a supporting position extending at least partially from the back surface so as to support the frame panel in a substantially upright viewing position, and the exterior panel is moveable between a covering position adjacent and parallel to the frame panel and a revealing position spaced from the frame panel.

Thus, one object of the invention is to provide a device that both packages a photograph for protected transport and provides a mechanism for displaying a photograph in an appealing manner after transport. The back and frame panels cooperate to frame a photograph for display while the exterior panel covers the photograph for transport. The supporter can maintain the back and frame panels in an upright position for display on a flat horizontal surface such as a desk or the like.

Another object is to provide a device that protects and frames and also can be used as a mailing envelope and to convey written materials. Such a device eliminates the need for an additional envelope and writing paper. The back surface of the exterior panel can include written materials and the front surface thereof can include address information similar to a postcard.

Preferably, the back panel is substantially the same size and shape as the frame panel, the frame panel is substantially rectangular, the aperture is centrally located, and the aperture defines an area that is less than the area defined by a photograph to be secured.

Also preferably, the back panel includes a perforated line adjacent and substantially parallel to the second lateral edge of the back panel separating the back panel into first and second portions. The perforated line facilitates purposeful separation of the first and second portions. In the alternative the fold line between the back and exterior panels forms a perforated line, the perforated line facilitating purposeful separation of the back and exterior panels.

Thus, another object is to provide a device that can facilitate the objects identified above that resembles a frame as opposed to a card or the like when used to display a photograph. After the device and photograph are received, the exterior panel can be separated along a perforated line and discarded leaving the framing portion and back panel.

In one embodiment the supporter includes a base member and a brace member, the at least one fold line between the supporter and the back frame portion includes first and second fold lines, and the base member includes upper and lower portions disposed adjacent the upper and lower edges of the frame panel respectively. When the supporter is in the supporting position, the base member extends outwardly from the first fold line, the lower end of the base member positionable so as to contact a supporting surface, the brace member extending outwardly from the second fold line so as to contact and maintain the base member in the supporting position.

When the supporter is in the supporting position, the base member extends substantially perpendicular to the frame panel and the brace member extends substantially perpendicular to both the frame panel and the base member. Preferably, the first fold line is parallel to the lateral edges of the frame panel.

Yet another object of the invention is to provide a supporter that is formed from a single blank which can offer sufficient support to other blank members in an upright position. The brace member can support the base member and the two members can cooperate to maintain an upright position.

The supporter may include first and second supporters, each of the first and second supporters connected to the back frame portion along a different fold line. In this case, the first supporter is moveable into a supporting position wherein the frame panel is in a first upright position having the upper edge of the frame panel above the lower edge, both the upper and lower edges being substantially horizontal. The second supporter is moveable into a supporting position wherein the frame panel is in a second upright position having one of the lateral edges of the panel above the other lateral edge, both lateral edges being substantially horizontal.

Another object is to provide a device that meets the above objectives and can support a photograph in more than one upright viewing orientation. By providing two supporters or stands having different orientations, a photograph can be displayed in either of two different orientations (e.g. lengthwise (horizontally) or widthwise (vertically)).

Also, preferably, the frame panel further includes an aperture panel positioned within the aperture and connected by a perforated die cut mesh. This aperture panel serves to further protect a photograph during transport, displays advertising information and is removable by the purchaser, sender, or receiver to reveal a photo.

Preferably, the exterior panel includes front and back exterior panels that are connected along a fold line which is parallel to the fold line between the exterior panel and the back panel. The front exterior panel is connected to the back panel and is substantially the same size and shape as the frame panel. When in the closing position both the front and back exterior panels are substantially parallel to the frame panel, the front exterior panel is disposed adjacent the frame panel and the back exterior panel disposed adjacent the back panel. The back exterior panel may form an aperture.

The present invention also includes a photograph framing and mailing device including a frame panel having two lateral edges, upper and lower edges, and front and rear surfaces, the frame panel forming an aperture, upper and lower flap panels connected at fold lines to the upper and lower edges of the frame panel respectively the upper and lower flap panels folded at the fold lines so as to be disposed parallel to the rear surface of the frame panel, a back panel having first and second lateral edges and front and back surfaces, the back panel includes a back frame portion and a supporter that is connected to the back frame portion by at least one fold line, the first lateral edge of the back panel connected to a lateral edge of the frame panel at a fold line, the back panel folded at the fold line so as to be disposed parallel to the frame panel adjacent the flap panels, and an exterior panel being sized and shaped so as to be at least as large as the frame panel, the exterior panel has two lateral edges, the first lateral edge of the exterior panel connected to the second lateral edge of the back panel along a fold line.

The upper and lower flap panels and the frame panel form a structure within which a photograph is securable, the supporter is moveable between a stowed position secured in place by thin connectors (not die-cut) parallel to the frame panel and a supporting position extending at least partially from the back surface so as to support the frame panel in a substantially upright viewing position, and the exterior panel is moveable between a covering position adjacent and parallel to the frame panel and a revealing position spaced from the frame panel. This device may have all or some of the features identified above.

In addition, this device may include retaining means on the back surface of the back panel for maintaining the back exterior panel in the closed position. Preferably, the retaining means includes peal and stick tape or a glue substance.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DESCRIPTION OF THE PREFERRED EMBODIMENT

Figure 1:
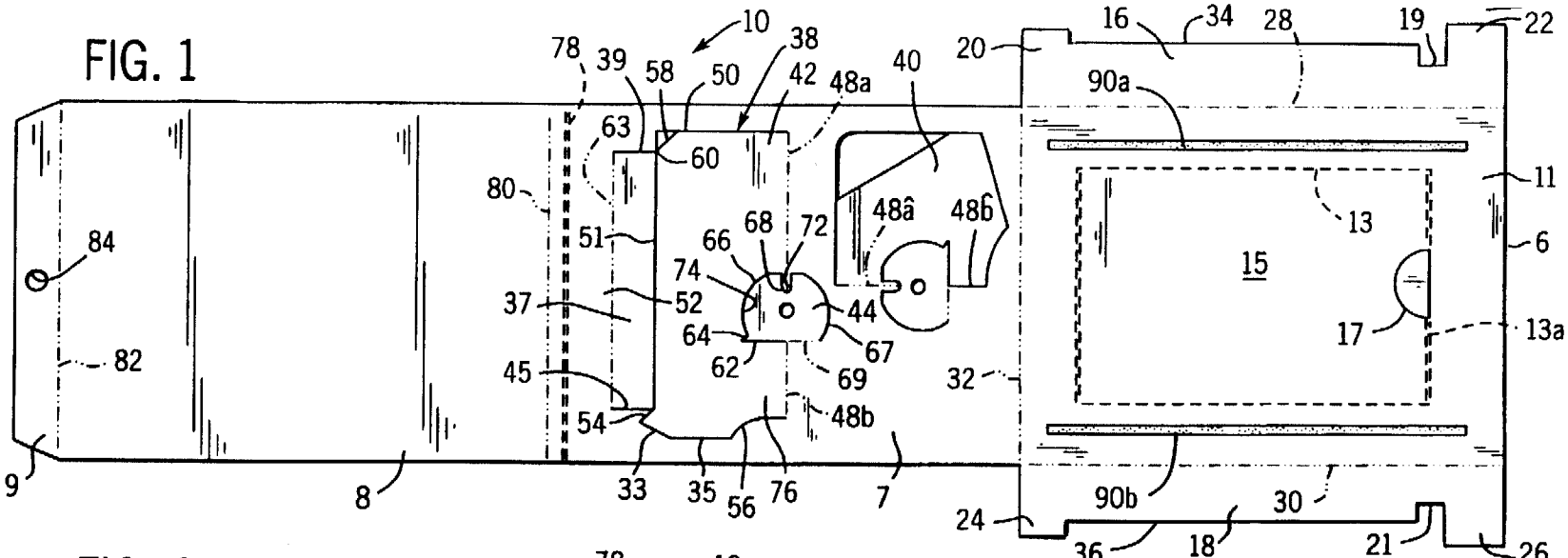
FIG. 1 is a view of a preferred embodiment of a paperboard blank that can be used to form a holder according to with the present invention.

Referring now to FIG. 1 a blank 10 is formed of thin gauge paper board or cardboard. When fully set up, the blank 10 forms a packaging and framing device 12 shown in FIG. 9.

The blank 10 is provided with a plurality of fold lines and cuts which are adapted to cooperate with one another so as to form the device 12. The blank 10 generally includes a frame panel 6, a back panel 7, a front exterior panel 8, a back exterior panel 9, an aperture panel 15 and upper and lower flap panels 16, 18 respectively. The panels are connected along fold lines and perforated lines as will be described in detail below. In the description which follows, the term "fold line" refers to a line between panels which facilitates easy bending between adjacent panels and the term "perforated line" is used to indicate a perforated area where two adjacent panels can be separated relatively easily.

In a preferred embodiment, the frame panel 6 is substantially rectangular in shape having one lateral edge defined by fold line 32, an upper edge defined by fold line 28, and a lower edge defined by fold line 30. The aperture panel 15 is substantially the same shape as the frame panel 6, of a smaller area than frame panel 6, and centrally located in the frame panel 6. Thus, the aperture panel 15 and edges of the frame panel 6 define a frame portion 11 around the peripheral area of the frame panel 6. The frame portion 11 and aperture panel 15 are separated by a perforated line 13 which circumscribes the aperture panel 15. If desired, after a photo is inserted in the device 10, the aperture panel 15, which is primarily provided for advertising, can be removed. In a preferred embodiment, a finger hole 17 is provided in the aperture panel 15 which facilitates insertion of a finger or the like for the purpose of separating the aperture panel 15 from the frame portion 11 as will be described in more detail below. In the alternative, the aperture panel 15 could be provided with a diagonal corner notch (not shown) to facilitate removal.

Figure 2:
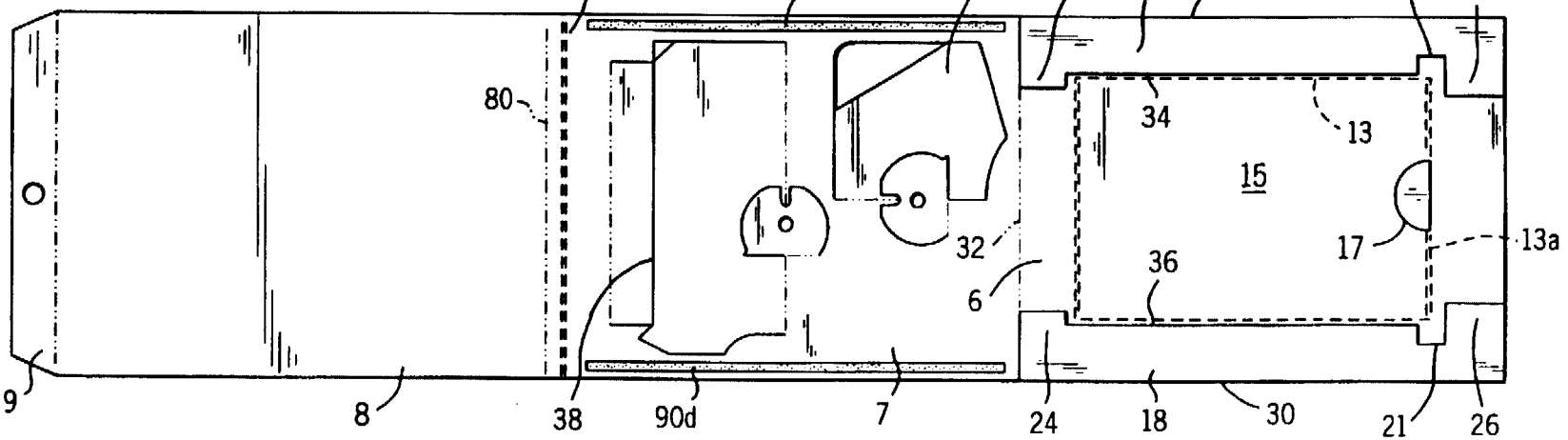
FIG. 2 is a top plan view of the blank of FIG. 1, partially folded.

The upper and lower flap panels 16, 18 are attached at fold lines 28, 30 to the upper and lower edges of the frame panel 6 respectively. Each of the flap panels 16, 18 extends from the frame panel 6 along the entire length of the associated fold lines 28, 30 respectively. At either end of each fold line 28, 30, the flap panels 16, 18 extend relatively further, providing first side extensions 20, 24 and second side extensions 22, 26 respectively. Between each second side extension 22, 26 and the remainder of an associated flap panel 16, 18 respectively, the flap panels 16, 18 define upper and lower symmetrical notches 19, 21 which allow picture insertion as described below. Referring also to FIG. 2, the flap panels 16, 18 and side extensions 20, 22, 24, 26 should be formed so that when the upper and lower flap panels 16, 18 are folded so as to be parallel to the frame panel 6, the internal edge 34, 36 of each flap panel 16, 18 circumscribed an adjacent portion of the perforated line 13.

Referring again to FIG. 1, the back panel 7 is connected to the frame panel 6 along fold line 32. Preferably the back panel 7 is of a size and shape substantially similar to the size and shape of the frame panel 6. The back panel includes a plurality of cuts and folds which provide first and second supporters 38, 40.

Because both of the supporters 38, 40 have substantially the same design, the only differences between the supporters 38, 40 being size, orientation, and shape specifics, only the first and larger supporter 38 will be described in detail here, the orientation of the second supporter 40 being described below. The first supporter 38 includes a base member 42 and a brace member 44. The portions of the back panel 7 which do not comprise the base and brace members will be referred to herein as the back frame portion 46. The base member 42 is attached to the back frame portion 46 along two aligned fold lines **48*a*, 48*b* which are separated by brace member 44. Together the two fold lines 48*a*, 48*b* extend approximately three-quarters of the height of the back panel 7, are centrally located along the length of the back panel 7, and are parallel to fold line 32**.

The first supporter 38 is defined by aligned fold lines **48*a*, 48*b*, an upper horizontal cut 50 extending from the upper end of fold line 48*a* toward the edge of the back panel 7 opposite fold line 32, a vertical cut 51 extending downwardly from the distal end of the horizontal cut 50 to a point lower than the bottom end of fold line 48*b*, a first angled cut 54 extending downwardly from the bottom end of vertical cut 51 and generally away from fold line 32, a second angled cut 33 extending downwardly from the bottom end of the first angled cut 54 generally toward fold line 32, a lower horizontal cut 35 extending from the bottom end of the second angled cut 33 toward fold line 32, and a hook cut 56 extending from the distal end of lower horizontal cut up to the lower end of the fold line 48*b*, the hook cut 56 being downwardly concave. A third angled cut 58 sheers off the corner between the horizontal cut 50 and the vertical cut 51 leaving an opening 60 between the back frame portion 46 and the base member 42 for insertion of a finger or the like to pull the base member 42** out from a stored position and into a supporting position which will be described in more detail below.

Referring still to FIG. 1, an insertion tab 37 is formed by upper and lower tab cuts 39, 45. The tab cuts 39, 45 extend away from fold line 32, the upper cut 34 extending from the lower end of third angled cut 58 and the lower cut 45 extending from the upper end of first angled cut 54. A vertical tab fold line 63 traverses the distance between the distal ends of the upper and lower cuts 39, 45.

Figure 12:
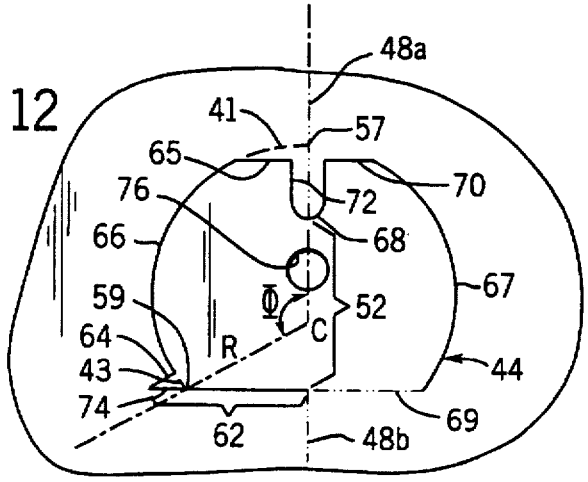
FIG. 12 is a blowup view of a preferred brace member.

Referring now to FIGS. 1 and 12, the brace member 44 is formed by a first horizontal cut 62 extending away from fold line 32 from the top end of fold line **48*b*. An acute cut 64 extends upwardly and generally toward fold line 32 so as to make an acute angle with the horizontal line 62, the acute cut 64 being relatively short when compared to horizontal cut 62. A first circular cut 66 extends from the distal end of the acute cut 64 upwardly making an arc concavely facing fold line 32. A second horizontal cut 65 extends from the distal end of the first circular cut 66 toward fold line 32 which stops just short of fold line 48*a* and is provided at a height a short distance above the lower end of fold line 48*a*. An arcuate cut 68 extends from the distal end of the second horizontal cut 65, through the lower end of fold line 48*a*, up to a point at the same height as the second horizontal cut 65, on the other side of fold line 48*a*, the arcuate cut being symmetrical about fold line 48*a* and concavely facing upwardly. A third horizontal cut 70, aligned with and substantially the same length as the second horizontal cut 65, extends from the distal end of the arcuate cut 68 toward fold line 32. A second circular cut 67 extends from the distal end of the third horizontal cut 70 downwardly making an arc concavely facing in the direction opposite fold line 32 and terminating at the end of a fold line 69. The first and second circular cuts 66, 67 are concentric and have identical radii. Fold line 69 is aligned with the first horizontal cut 62 and traverses the distance between cut 62 and the lower end of circular cut 67. Brace member 44 can be rotated around fold line 69** if desired.

The arcuate cut 68 defines a first notch 72 in the brace member 44 and acute cut 64 provides a second notch 74 extending into the base member 42. The notches 72 and 74 cooperate to maintain the base member 42 in a supporting position as will be described in more detail below.

Referring still to FIG. 1, while the second supporter 40 has a slightly different shape than the first supporter 38, its construction should be clear from the description above and a perusal of FIG. 1. The second supporter 40 is shifted so as to offer support to the device 12 in a different orientation rotated 90° from the first supporter 38. To this end, aligned fold lines 48a and 48b associated with the second supporter 40 are horizontal and perpendicular to fold line 32 as opposed to being vertical and parallel thereto, and all other fold lines and cuts are oriented accordingly.

Near the edge of the back panel 7 opposite fold line 32, the back panel 7 includes a perforated line 78 parallel to fold line 32 which facilitates purposeful separation of the exterior panels 8, 9 from the back panel 7 as will be described in more detail below.

The front exterior panel 8 is connected to the back panel 7 along fold line 80 which is substantially parallel to both the perforated line 78 and the fold line 32. In a preferred embodiment, the front exterior panel 8 is the same size and shape as the back and frame panels 7 and 6 respectively. The back exterior panel 9 is connected to the front exterior panel 8 along fold line 82 which is parallel to fold line 80. While the back exterior panel 9 can take many forms, in FIG. 1, the back exterior panel 9 is shown as being a tab type panel of reduced area and includes a centrally located aperture 84.

For the purposes of this disclosure, when referring to any of the panels described above, the phrase "back surface" will be used to describe the surfaces shown in FIG. 1 whereas the phrase "front surface" will be used to describe surfaces facing in the opposite direction that are hidden in FIG. 1.

Turning now to FIGS. 2–5, in folding the blank 10 to form the framing and packaging device 12, both upper and lower flap panels 16, 18 are folded along fold lines 28, 30 respectively so that they are parallel to the frame panel 6 and their back surfaces are adjacent the back surface of the frame panel 6. As seen in FIG. 2, in this position, the internal edges 34, 36 of each flap panel 16, 18 circumscribe the perforated line 13, and the notches 19, 20 are spaced apart above and below a lateral edge 13a of the aperture panel 15, respectively.

Figure 3:
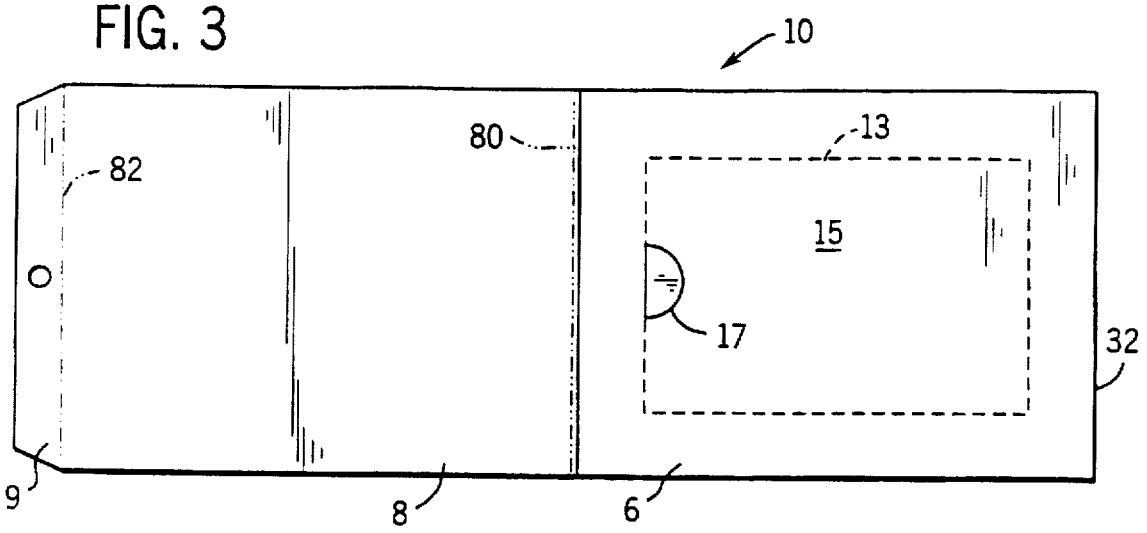
FIG. 3 is a top plan view of the blank of FIG. 2 folded and glued as a customer would receive.

Next, referring to FIG. 3, the frame panel 6 is folded along fold line 32 so that the frame panel 6 is substantially parallel to the back panel 7, the back surface of the frame panel 6 being adjacent the back surface of the back panel 7. In this position, the flap panels 16, 18 are sandwiched between the frame panel 6 and the back panel 7.

Figure 4:
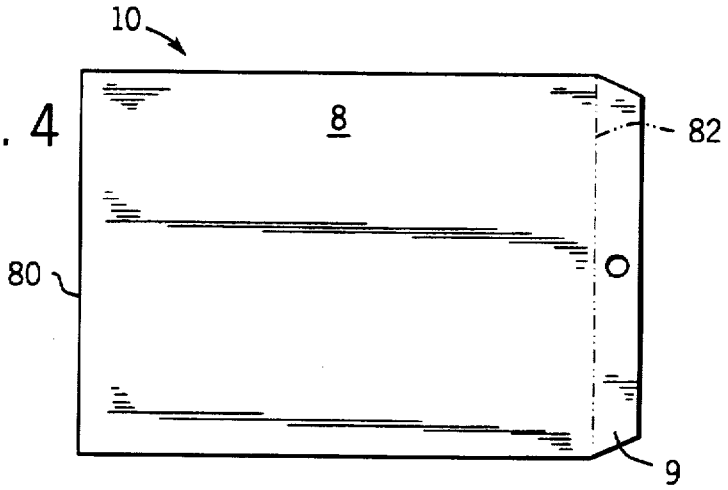
FIG. 4 is a top plan view of the blank of FIG. 3, in a further folded position (and before sealing cover flap)
Figure 5:
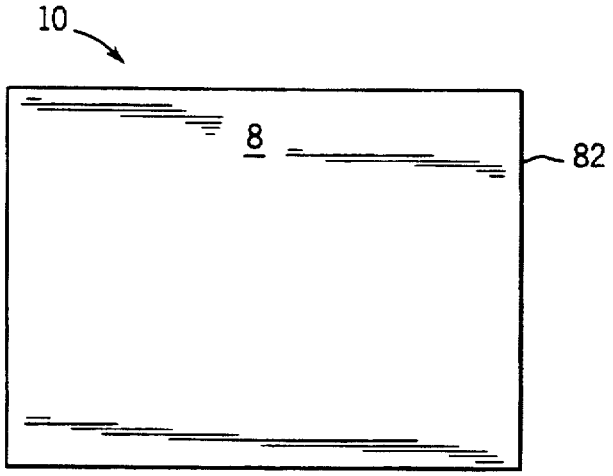
FIG. 5 is a top plan view of the blank of FIG. 4 completely folded (and ready to be mailed)

Referring now to FIG. 4, the front exterior panel 8 can be folded along fold line 80 so that the back surface of the back exterior panel 8 is substantially parallel and adjacent the front surface of frame panel 6. In this position, the exterior panel 8 protects the front surface of the frame panel 6. Referring to FIG. 5, the back exterior panel 9 can be folded along fold line 82 so that the back surface of the back exterior panel 9 is substantially parallel to and adjacent the front surface of the back panel 7.

Figure 6:
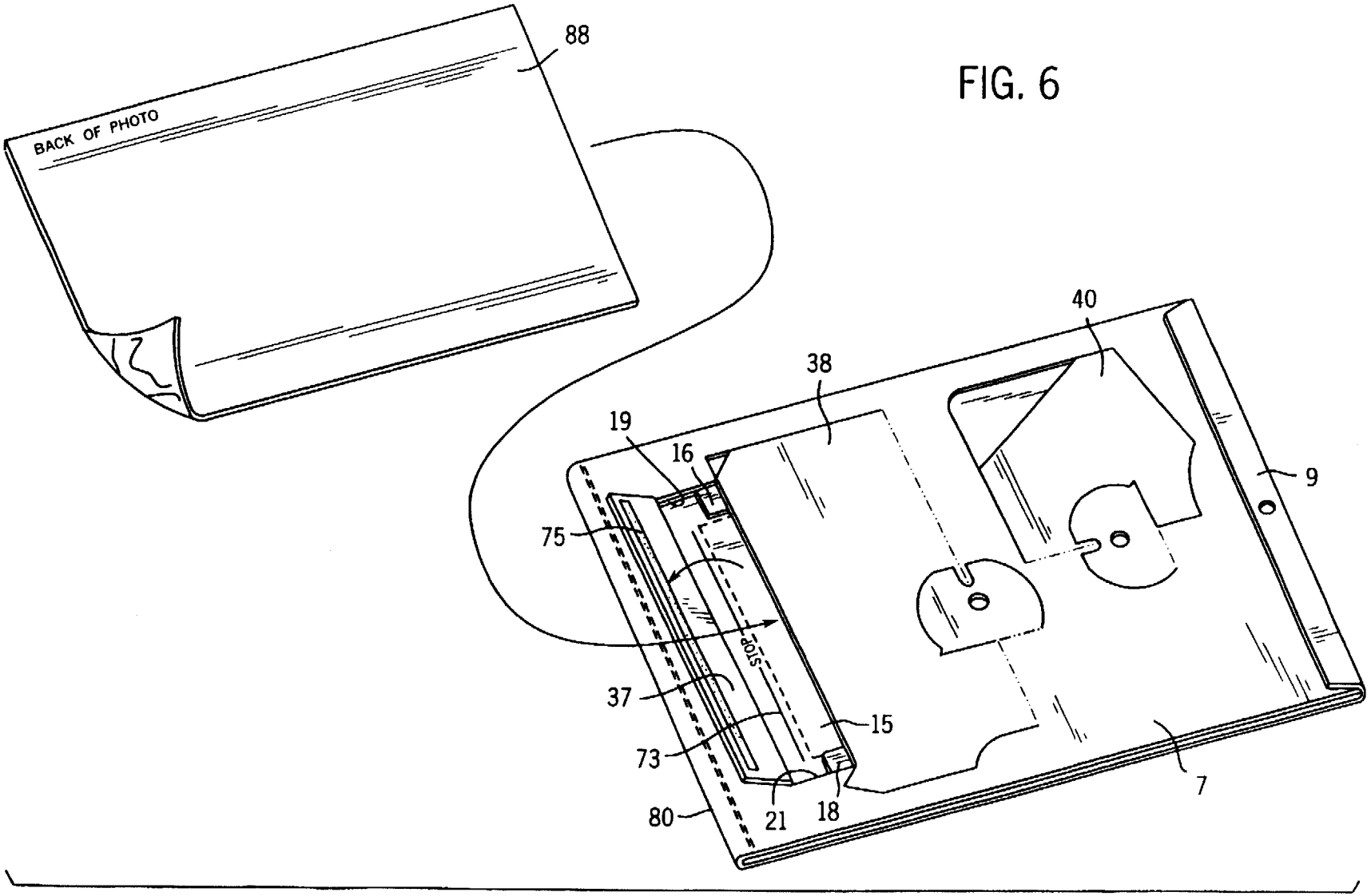
FIG. 6 is a perspective view of an inventive blank indicating insertion of a picture.

When so folded, the blank 10 forms a pouch for receiving a picture or photograph. Referring now to FIG. 6, once constructed, a photograph 88 can be inserted as follows. First, the constructed mailer is flipped over so that the front surface of the back panel 7 is facing upwardly. Next, the tab panel 37 can be pried open with a finger or the like, swinging about tab fold line 63 into an open position. A strip of peel and seal tape 75 is provided on the underside of tab 37. With the tab 37 so positioned, notches 19, 20 in the upper and lower flap panels 16, 18 are observable.

To insert a picture 88, the visible portions of the upper and lower flap panels 16, 18 can be raised slightly while the photograph 88 is fed thereunder in the direction of arrow 71 through notches 19, 20. The photograph 88 should be inserted face down to position it properly for later receiving. Preferably, a stop line 73 is printed adjacent the aperture panel 15 indicating how far a standard sized picture should be inserted. Referring also to FIG. 2, when properly positioned, the photograph will abut the upper and lower first side extensions 20, 24 which will limit lateral picture movement. In addition, the upper and lower second side extensions 22, 26 will also limit lateral movement. To assist in proper positioning, the aperture panel 15 can be removed and discarded if desired. This is intended where instructions or advertising have been included on the aperture panel. After the photograph 88 is inserted, the top layer of peel and seal tape 75 can be removed exposing a tacky underlayer. The tab 37 should then be swung down into its original position wherein the tacky underlayer contacts the backside of the photograph further securing the photograph within the pouch.

In this closed position, the photograph inside the pouch 86 is entirely enclosed in the device and therefore it is protected and ready for shipping. As will become apparent below, the exterior panels 8, 9 are meant to be discarded after shipping. Therefore, if desired, address information can be placed on, and postage can be affixed to, the front surface of the front exterior panel 8 (see FIG. 5). In this manner, the exterior panel 8 can be used both to protect the other panels and the photograph and as a shipping envelope alleviating the need for additional packaging materials.

Figure 7:
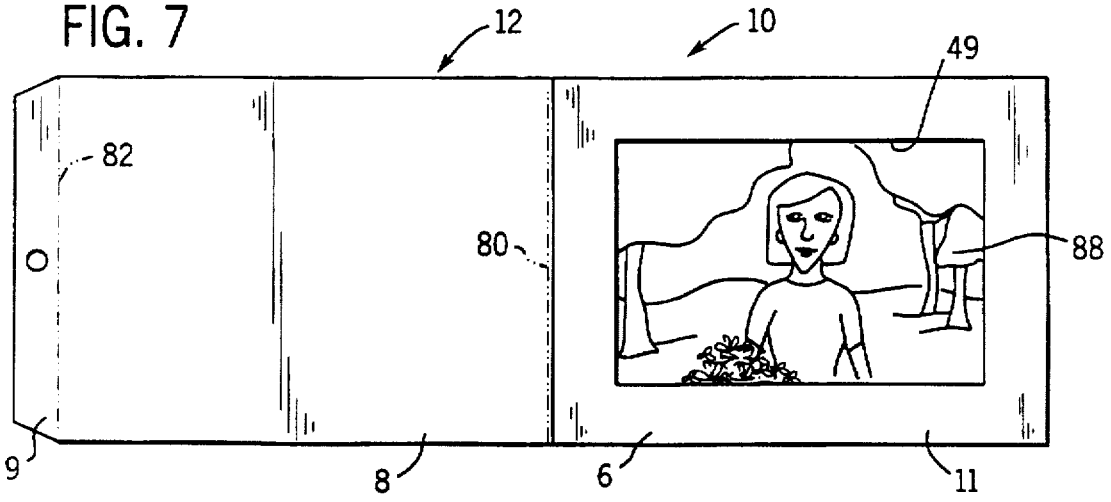
FIG. 7 is a top plan view of the blank shown in FIG. 3 with a protecting or advertising sheath removed.

Referring again to FIG. 3, when the package is received after shipping, the receiver folds back the back and front exterior panels 9, 8 to reveal the front surface of the frame panel 6. In this position, any writing (e.g. letter or note) on the back surface of the front exterior panel, on the frame panel 6, or on the aperture panel 15 can be observed and read. Where the aperture panel 15 was removed prior to shipping, the photograph is immediately revealed when the front and back exterior panels 8, 9 are removed. Referring also to FIG. 7, where the aperture panel is left intact during shipping, to reveal the photograph which is stored in the pouch, the receiver can force his or her finger into the finger tab 17 and pull upwardly. Because the aperture panel 15 is only held in place by a perforated line 13, the aperture panel 15 can easily be removed and discarded, thus providing aperture 49 and revealing the photograph 88 framed by the frame portion 11 of the frame panel 6.

Figure 8:
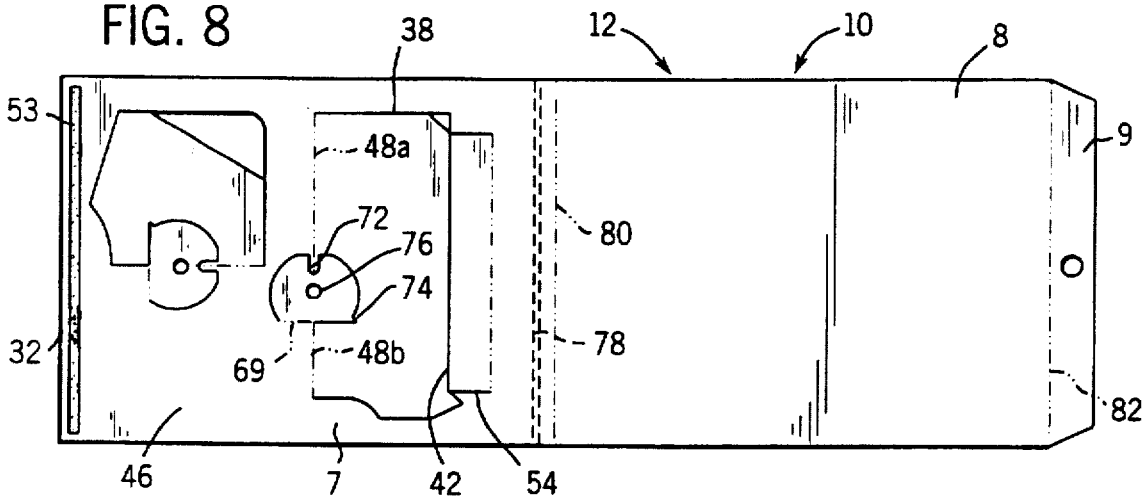
FIG. 8 is a bottom plan view of the blank shown in FIG. 7.
Figure 9:
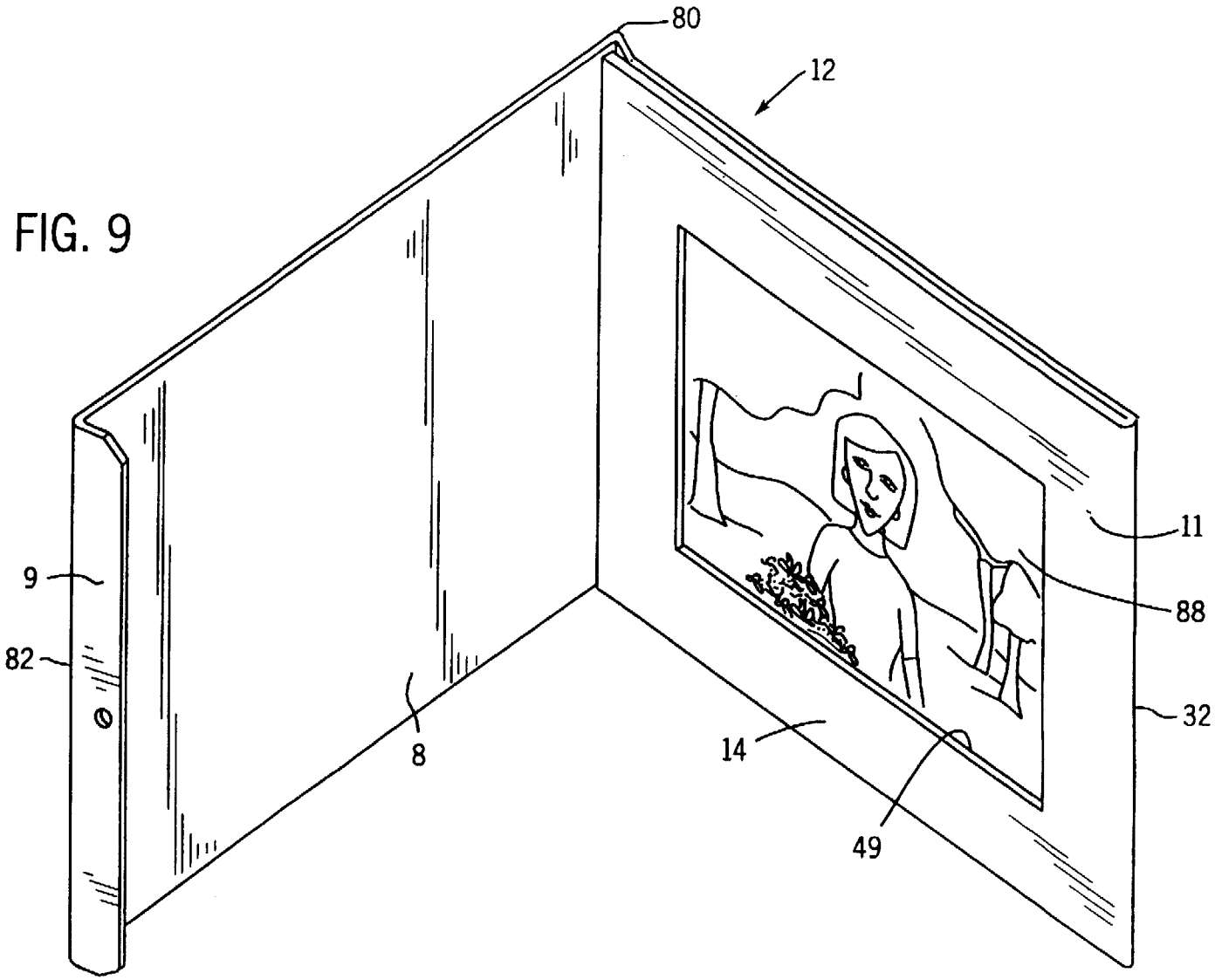
FIG. 9 is perspective view of a mailing and framing device including a message or advertising sheath according to the present invention.
Figure 11:
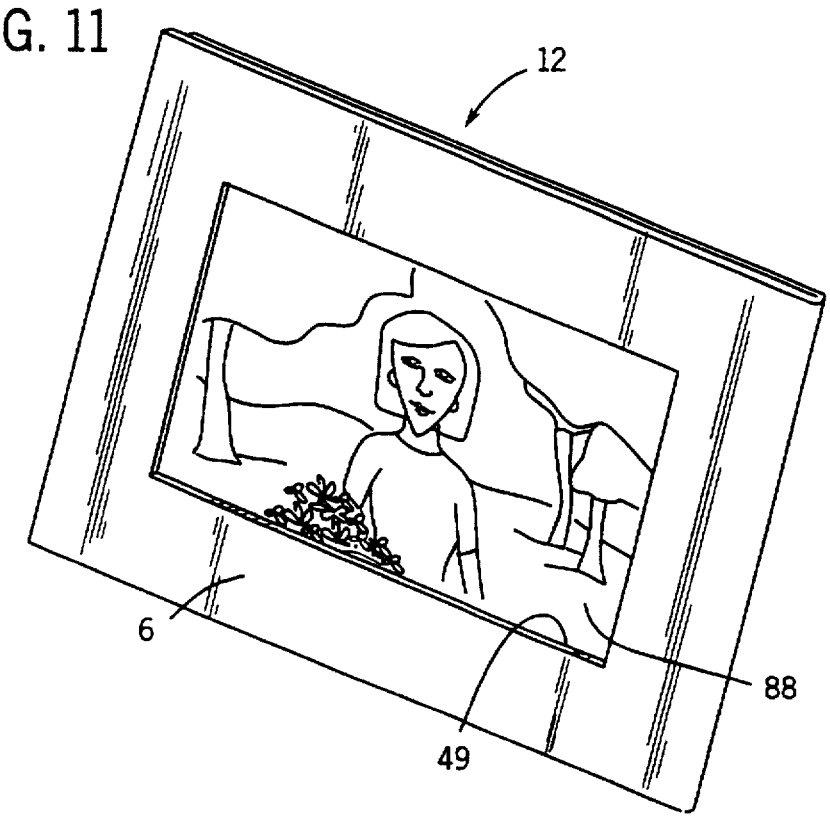
FIG. 11 is a front perspective view of the blank shown in FIG. 10.

Referring also to FIGS. 8 and 9, a view from the back of the package and a perspective view of the package of FIG. 7 can be observed. If desired, the exterior panels 8, 9 can be removed from the other portions of the blank by separating the exterior panels 8, 9 from the back panel 7 along perforated line 78. Referring also to FIG. 11, where the exterior panels 8, 9 are removed, the frame panel 6 forms an attractive frame around the photograph 88. In the alternative, if desired, the device of the present invention can be used as a matting by positioning the photograph and device (less the exterior panels) in a more substantial frame. To this end, in a preferred embodiment, the dimensions of the frame panel are chosen so that the device fits standard sized frames. For example, the frame panel 6 may have outside dimensions of 5"×7" for a 5×7 standard frame or 8"×10" outside dimension for a 8×10 frame.

Figure 10:
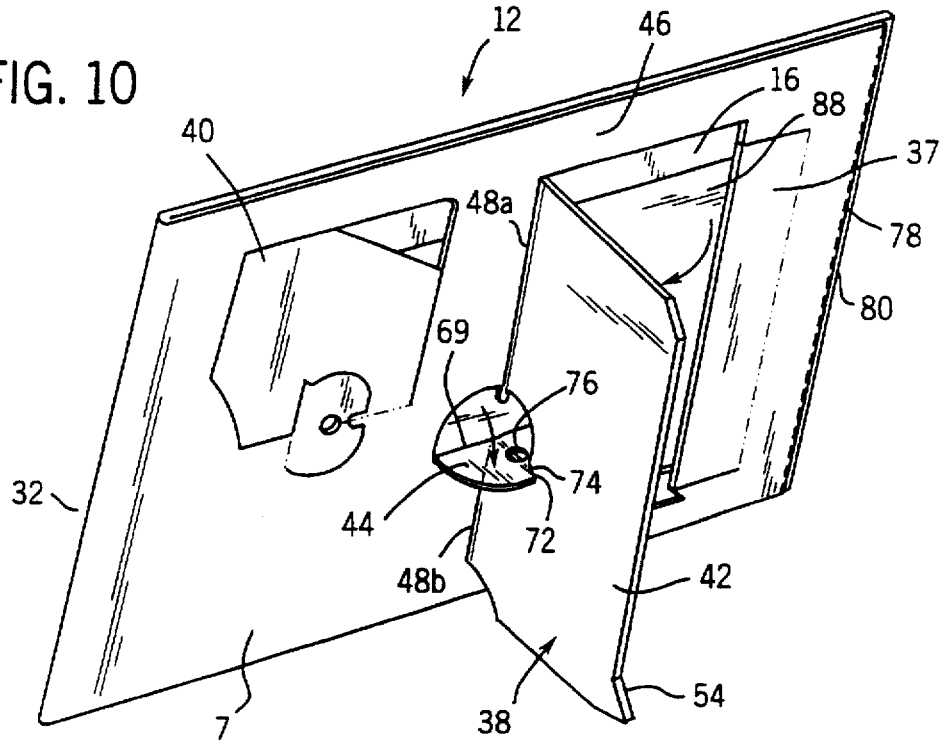
FIG. 10 is a perspective view of the blanks shown in FIGS. 7 and 8 from the back side with a portion of the blank removed and a supporter in a supporting position.

Referring now to FIGS. 8 and 10, if it is desired to have the framed photograph stand upright for viewing, the first supporter 38 can be extended outwardly from the back panel 7 into a supporting position. To place the supporter 38 into the supporting position a user sticks a finger through opening 60 to force the base member 42 away from the back frame portion 46. The base member 42 is folded along fold lines 48a, 48b so as to be substantially perpendicular to the back panel 7.

Next, the brace member 44 is folded downwardly along fold line 69 so as to be substantially perpendicular to both the back panel 7 and the base member 42. The brace member 44 sweeps 40 through the void formed in the base member 42 by cuts 66 and 65. Referring to FIG. 12, in the preferred embodiment, the length of horizontal cut 62, brace length 52 measured from the top end of fold line **48*b* to the bottom end of fold line 48*a*, and the number of degrees through which the first circular cut 66 sweeps are particularly important to the proper functioning of the supporter 38. In FIG. 12, the center of circular cut 66 is labeled C, the radius of the cut 66 is labeled R, and arc continuance lines 41, 43** are included solely for the purpose of facilitating this explanation (i.e. none of these markings are functional).

Continuance line 41 continues the arc of circular cut 66 about center point C to fold line **48*a* while line 43 continues cut 66 to horizontal cut 62. The cut 66 and lines 41 and 43 together defining an arc Φ about center point C. Importantly, the entire arc Φ should be greater than 90° so that the distance between the intersection point 57 of line 41 and fold line 48*a* and the top end of fold line 48*b* is greater than the distance between the intersection point 59 of line 43 and cut 62 and the top of fold line 48*b*. The brace length 52 and length of cut 62 are greater than the radius R and approximately equal. In addition, the distance between the top end of fold line 48*b* and point 59 should be slightly less than the brace length 52**.

With these dimensions, when the brace member 44 is folded downwardly along line 69, near the point where the brace member 44 becomes horizontal, the lower most edge of arcuate cut 68 contacts the base member 42 just above point 59. In order to move the brace member 44 into a completely horizontal position, either one or both of the base or brace members 42, 44 must be slightly deformed. This is easily accomplished as the entire blank is generally flexible and resilient. When deformed, the brace member 44 can be made horizontal and nearly parallel to the cut 62. In this position, notch 72 becomes stuck within notch 74 and effectively locks the base member 42 into position perpendicular to the back panel 7. The device 12 can be leaned backward so that the weight of the device rests on the second angled edge 33.

Preferably, referring again to FIG. 8, the second angled edge 33 makes between a 10° and 30° angle with the horizontal so that the front surface of the frame panel 6 makes a similar angel (i.e. between 10° and a 30°) with the vertical when resting on the supporter 38.

Referring again to FIGS. 1 and 10, the second supporter 40 works in the same manner as the first 38, except that it is oriented differently with respect to the back frame portion 46. The second supporter 40 is meant to support the device 12 in an upright position with fold lines 32 and 80 horizontal and fold line 32 below fold line 80. The second supporter 40 enables the device 12 to frame and display an "oblong" vertically oriented photograph, one where the height is greater than the width, in an upright position. Thus, depending upon the nature of the photograph to be displayed, either one or the other supporter 38, 40 should be positioned in the supporting position while the other supporter is in the stowed position.

Referring again to FIG. 1, preferably, glue strips are provided along various portions of the panels 6 and 7 which help to maintain the device in a functional orientation and help to maintain a photograph in a preferred viewing position relative to the aperture 49. To this end, two parallel and horizontal glue strips **90*a*, 90*b* are provided, one strip 90*a* above and one strip 90*b* below the aperture panel 15 extending the length of, and disposed on, the back surface of the frame panel 6. Referring also to FIG. 2, when the upper and lower flaps 16, 18 are folded to form the photograph securing pouch, glue strips 90*a*, 90*b* secure the flaps 16, 18 adjacent and parallel to the frame panel 6**.

Importantly, the glue strips **90*a*, 90*b* should be oriented such that the edges 34, 36 of the flaps 16, 18 are unglued and can be slightly separated from the frame panel 6. When so oriented, a photograph can be slid between the flap edges 34, 36 and the frame panel 6 as shown in FIG. 6. Where devices 12 are designed for specifically sized photographs, the glue strips 90*a*, 90*b* should be oriented to define an area only slightly greater than the height of the photograph to increase the friction between the photograph and the walls of the pouch 86**, thus holding the photograph securely in a desired viewing position.

Referring still to FIG. 2, two additional horizontal and parallel glue strips **90*c*, 90*d* can be provided on the back surface of the back panel 7 above and below the supporters 38, 40 respectively. Referring also to FIG. 3, when the frame panel 6 is folded about fold line 32, the front surface of the flaps 16, 18 become glued to the back surface of the back panel 7, thus securing the flaps 16, 18 and back panel 7** in parallel orientation.

Referring again to FIG. 8, preferably, a single peel and stick strip 53 is provided on the front surface of the back panel 7 adjacent fold line 32. When the device 12 is fully formed for shipping (see FIG. 5) the back surface of back exterior panel 9 can be pressed against the stick strip 53 and held in the closed position until forcibly opened after shipping.

Referring to FIGS. 8 and 12, each brace member 44 also forms a central aperture 76 aligned with fold lines **48*a*, 48*b*. The apertures 76 are provided so that, if desired, a user may hang the device 12 on a hook or nail protruding from a wall or the like as opposed to supporting the device on a horizontal surface. The apertures 76** make the device even more versatile.

While the above description details various embodiments of an apparatus according to the present invention, it should be understood that the devices described above are only exemplary and do not limit the scope of the invention, and that various modifications could be made by those skilled in the art that would fall under the scope of the invention. For example, while the glue strips have been identified as being placed in certain locations with respect to the device panels, clearly, other glue configurations could be used to achieve the same securing purposes.

In addition, various other flap panel configurations could be used to secure a photograph within a resulting pouch. Referring to FIGS. 3 and 4, while the back exterior panel is shown as being a tab, clearly the back exterior panel 9 could be another panel substantially identical to the front exterior panel 8 so that, when the back exterior panel 9 is folded along fold line 82, it substantially covers the entire front surface of the back panel to protect the back panel during shipping. In addition to protecting the back panel during shipping, a configuration including an enlarged back exterior panel 9 would also provide additional space for written communication on its back surface.

While all of the embodiments described above include an aperture panel 15, clearly an aperture panel is not required and the present invention would operate sufficiently without such a panel. Where two differently aligned supporters 38, 40 are shown on each device in the preferred embodiments.

the invention also contemplates a single supporter or multiple supporters that could operate together to support a device in a single upright orientation. Furthermore, while each embodiment above includes flap panels, other embodiments may not include such panels, the back and front panels alone being configured to secure a photograph in a secure viewing and packaging position. Moreover, while each embodiment includes specifically configured supporters, any type of supporter might be included and, in fact, no supporter is necessary to practice the invention. To apprise the public of the scope of this invention we make the following claims:

We claim:

1. A blank sheet of foldable material for use in forming a photograph framing and mailing device, the blank sheet comprising:

a frame panel having two lateral edges and forming an aperture;

a back panel having first and second lateral edges, the first lateral edge of the back panel connected to a lateral edge of the frame panel at a fold line; and an exterior panel being sized and shaped so as to cover the frame panel when positioned parallel and adjacent thereto, the exterior panel having two lateral edges, the first lateral edge of the exterior panel connected to the second lateral edge of the back panel along a fold line;

whereby, the panels of the blank sheet are juxtaposed such that when the device is assembled by folding the sheet along the fold lines, the panels form a structure within which a photograph is securable so as to be at least partially viewable through said aperture, and the exterior panel is moveable between a covering position adjacent and parallel to the frame panel and a revealing position spaced from the frame panel wherein the frame panel includes upper and lower edges, the blank further includes upper and lower flap panels connected at fold lines to the upper and lower edges of the frame panel respectively, and whereby when the device is assembled by folding the sheet along the fold lines, the upper and lower flap panels and the frame panel form the structure within the photograph is securable.

2. The blank of claim 1 wherein the back panel is substantially the same size and shape as the frame panel and the frame panel is substantially rectangular.

3. The blank as recited in claim 1 wherein the back panel includes a perforated line adjacent and substantially parallel to the second lateral edge of the back panel separating the back panel into first and second portions, the perforated line facilitating purposeful separation of the first and second portions.

4. The blank of claim 1 wherein the aperture is centrally located in the frame panel.

5. The blank as recited in claim 1 wherein the frame panel further includes an aperture panel positioned within the aperture, the aperture panel and frame panel separated by a perforated line.

6. The blank of claim 1 wherein the exterior panel includes front and back exterior panels that are connected along a fold line, the front exterior panel connected to the back panel and being substantially the same size and shape as the frame panel, when in the covering position both the front and back exterior panels frame panel, the back panel being folded so as to be adjacent the flap panels, and, whereby, the upper and lower flap panels in the frame panel form the structure in which the photograph is securable.

7. The blank as recited in claim 1 wherein the back panel includes a back frame portion and a supporter that is connected to the back frame portion by at least one fold line and, whereby, the supporter and back frame portion are juxtaposed such that when the device is assembled by folding the sheet along the fold lines the supporter is moveable between a stowed position parallel to the frame panel and a supporting position extending at least partially normal to the frame panel so as to support the frame panel in an upright viewing position.

8. The blank of claim 7 wherein the supporter includes first and second supporters, each of the first and second supporters connected to the back frame portion along a different fold line, the first supporter moveable into a supporting position wherein the frame panel is in a first upright position having the upper edge of the frame panel above the lower edge, both the upper and lower edges being substantially horizontal, the second supporter moveable into a supporting position wherein the frame panel is in a second upright position having one of the lateral edges of the panel above the other lateral edge, both lateral edges being substantially horizontal.

9. The blank of claim 7 wherein the supporter includes a base member and a brace member, the at least one fold line between the supporter and the back frame portion includes first and second fold lines, and the base member includes upper and lower portions disposed adjacent the upper and lower edges of the frame panel respectively, whereby, when the supporter is in the supporting position, the base member extends outwardly from the first fold line, the lower end of the base member positionable so as to contact a supporting surface, and the brace member extends outwardly from the second fold line so as to contact and maintain the base member in the supporting position.

10. The blank of claim 9 wherein, when the supporter is in the supporting position, the base member extends substantially perpendicular to the frame panel and the brace member extends substantially perpendicular to both the frame panel and the base member.

11. The blank as recited in claim 10 wherein the first fold line is parallel to the lateral edges of the frame panel.

12. A blank sheet of foldable material for use in forming a photograph framing and mailing device, the blank sheet comprising:

a frame panel having two lateral edges and forming an aperture;

a back panel having first and second lateral edges, the first lateral edge of the back panel connected to a lateral edge of the frame panel at a fold line; and an exterior panel being sized and shaped so as to cover the frame panel when positioned parallel and adjacent thereto, the exterior panel having two lateral edges, the first lateral edge of the exterior panel connected to the second lateral edge of the back panel along a fold line;

whereby, the panels of the blank sheet are juxtaposed such that when the device is assembled by folding the sheet along the fold lines, the panels form a structure within which a photograph is securable so as to be at least partially viewable through said aperture, and the exterior panel is moveable between a covering position adjacent and parallel to the frame panel and a revealing position spaced from the frame panel wherein the fold line between the back and exterior panels forms a perforated line, the perforated line facilitating purposeful separation of the back and exterior panels.

13. A blank sheet of foldable material for use in forming a photograph framing and mailing device, the blank sheet comprising:

a frame panel having two lateral edges and forming an aperture;

a back panel having first and second lateral edges, the first lateral edge of the back panel connected to a lateral edge of the frame panel at a fold line; and an exterior panel being sized and shaped so as to cover the frame panel when positioned parallel and adjacent thereto, the exterior panel having two lateral edges, the first lateral edge of the exterior panel connected to the second lateral edge of the back panel along a fold line;

whereby, the panels of the blank sheet are juxtaposed such that when the device is assembled by folding the sheet along the fold lines, the panels form a structure within which a photograph is securable so as to be at least partially viewable through said aperture, and the exterior panel is moveable between a covering position adjacent and parallel to the frame panel and a revealing position spaced from the frame panel wherein the back panel defines an insertion opening and the back panel includes an insertion tab movable between an open position wherein the insertion tab extends at least partially perpendicularly from the back panel and the insertion opening is unblocked, and a closed position wherein the insertion tab is parallel to the frame panel and at least partially blocks the insertion opening, the insertion opening positioned so that when the device is assembled, the opening is adjacent an edge of said aperture.

14. The blank of claim 13 wherein the aperture is rectangular and slightly smaller than a photograph to be framed and the opening is substantially the same length as said adjacent edge of the aperture.

15. The blank of claim 14 wherein a surface of the insertion tab facing the frame panel when the device is assembled includes a peel and stick layer of tape.

16. A photograph framing and mailing device comprising:

a frame panel having two lateral edges, and front and rear surfaces, the frame panel forming an aperture;

a back panel having first and second lateral edges, the first lateral edge of the back panel connected to a lateral edge of the frame panel at a fold line, the back panel folded at the fold line so as to be disposed parallel to the frame panel; and an exterior panel being sized and shaped so as to cover the frame panel when positioned parallel and adjacent thereto, the exterior panel having two lateral edges, the first lateral edge of the exterior panel connected to the second lateral edge of the back panel along a fold line;

whereby, the panels form a structure within which a photograph is securable and at least partially viewable through said aperture, and the exterior panel is moveable between a covering position adjacent and parallel to the frame panel and a revealing position spaced from the frame panel wherein the frame panel includes upper and lower edges, the device further including upper and lower flap panels connected at fold lines to the upper and lower edges of the frame panel respectively, the upper and lower flap panels folded at the fold lines so as to be disposed parallel to and adjacent the defined by the photograph to be positioned between the frame and flap panels.

17. The device of claim 16 wherein the back panel defines an insertion opening and the back panel includes an insertion tab movable between an open position wherein the tab extends at least partially perpendicularly from the back panel and the insertion opening is unblocked, and a closed position wherein the insertion tab is parallel to the frame panel and at least partially blocks the insertion opening, the insertion opening positioned so that when the device is assembled, the opening is adjacent an edge of said aperture.

18. The device of claim 17 wherein the aperture is rectangular and slightly smaller than a photograph to be framed and the opening is substantially the same length as said adjacent edge of the aperture.

19. The device of claim 16 wherein the back panel includes a back frame portion and a supporter that is connected to the back frame portion by at least one fold line and, whereby, the supporter is moveable between a stored position parallel to the frame panel and a supporting position extending at least partially normal to the frame panel so as to support the frame panel in an upright viewing position.

20. The device of claim 19 wherein the supporter includes a base member and a brace member, the at least one fold line between the supporter and the back frame portion includes first and second fold lines, and the base member includes upper and lower portions disposed adjacent the upper and lower edges of the frame panel respectively, when the supporter is in the supporting position, the base member extending outwardly from the first fold line, the lower end of the base member positionable so as to contact a supporting surface, the brace member extending outwardly from the second fold line so as to contact and maintain the base member in the supporting position.

21. The device of claim 16 wherein the back panel is substantially the same size and shape as the frame panel, the frame panel is substantially rectangular, and the aperture defines an area that is less than the area being substantially parallel to the frame panel, the front exterior panel disposed adjacent the frame panel and the back exterior panel disposed adjacent the back panel.

22. The device as recited in claim 16 wherein the back panel includes a perforated line adjacent and substantially parallel to the second lateral edge of the back panel separating the back panel into first and second portions, the perforated line facilitating purposeful separation of the first and second portions.

23. The device as recited in claim 16 wherein the fold line between the back and exterior panels forms a perforated line, the perforated line facilitating purposeful separation of the back and exterior panels.

24. The device of claim 16 wherein the exterior panel includes front and back exterior panels that are connected along a fold line, the front exterior panel connected to the back panel and being substantially the same size and shape as the frame panel, when in the closing position both the front and back exterior panels being substantially parallel to the frame panel, the front exterior panel disposed adjacent the frame panel and the back exterior panel disposed adjacent the back panel.

25. The device of claim 16 further including retaining means for maintaining the back exterior panel in the closed position.

* * * * *